US010309388B2

(12) United States Patent
Gaskill-Fox et al.

(10) Patent No.: US 10,309,388 B2
(45) Date of Patent: Jun. 4, 2019

(54) CONTINUOUS SAMPLE DELIVERY PERISTALTIC PUMP

(71) Applicant: Bio-Rad Laboratories, Inc., Hercules, CA (US)

(72) Inventors: Nathan Michael Gaskill-Fox, Fort Collins, CO (US); Daniel Nelson Fox, Bellvue, CO (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 172 days.

(21) Appl. No.: 15/242,122

(22) Filed: Aug. 19, 2016

(65) Prior Publication Data

US 2017/0051735 A1 Feb. 23, 2017

Related U.S. Application Data

(60) Provisional application No. 62/208,465, filed on Aug. 21, 2015.

(51) Int. Cl.
*F04B 43/00* (2006.01)
*F04B 43/12* (2006.01)

(52) U.S. Cl.
CPC ..... *F04B 43/1261* (2013.01); *F04B 43/0072* (2013.01); *F04B 43/1215* (2013.01); *F04B 43/1276* (2013.01)

(58) Field of Classification Search
CPC ..... F04B 43/088; F04B 13/00; F04B 23/04; F04B 43/1261; F04B 43/1215; F04B 43/1276; F04B 43/0072
See application file for complete search history.

(56) References Cited

U.S. PATENT DOCUMENTS 3,335,670 A * 8/1967 Williams ..... F04B 43/0054 417/477.7
4,445,826 A * 5/1984 Tarr ..... F04B 19/20 417/476

(Continued)

FOREIGN PATENT DOCUMENTS

CN 103423134 A 12/2013
CN 103874857 A 6/2014

(Continued)

OTHER PUBLICATIONS

International Preliminary Report on Patentability dated Mar. 8, 2018 issued in PCT/US16/47877.

(Continued)

*Primary Examiner* — Philip E Stimpert
(74) *Attorney, Agent, or Firm* — Weaver Austin Villeneuve & Sampson LLP

(57) ABSTRACT

A method and apparatus for pumping fluid through tubing are provided. The method includes orbiting first rollers around the periphery of a first disk at a first tangential speed in a first angular sector and a slower, second tangential speed in a second angular sector, orbiting second rollers around the periphery of a second disk at the second tangential speed, and increasing the pressure of fluid in tubing between one first roller and one second roller by causing the one first roller to fully compress the tubing at the first tangential speed and simultaneously causing the one second roller to fully compress the tubing at the second tangential speed. The apparatus includes a first disk with a recess in its periphery, the first angular sector with a nominal first radius, and a second angular sector with a nominal second radius; and a second disk with the nominal first radius and a recess in its periphery.

20 Claims, 11 Drawing Sheets

(56) References Cited

U.S. PATENT DOCUMENTS

| | | | | |
|---|---|---|---|---|
| 5,533,878 | A | 7/1996 | Iwata | |
| 5,711,654 | A | 1/1998 | Afflerbaugh et al. | |
| 8,939,740 | B2 | 1/2015 | Norman et al. | |
| 2004/0131487 | A1* | 7/2004 | Ito | F04B 43/1253 417/476 |
| 2009/0214365 | A1 | 8/2009 | Norman et al. | |
| 2010/0316516 | A1 | 12/2010 | Vidal | |
| 2014/0356203 | A1 | 12/2014 | Baxter | |
| 2014/0356205 | A1 | 12/2014 | Baxter et al. | |

FOREIGN PATENT DOCUMENTS

| | | | |
|---|---|---|---|
| DE | 3326766 | A1 | 2/1984 |
| JP | 2008/261240 | | 10/2008 |
| JP | 2013/072287 | | 4/2013 |
| WO | WO 2017/035020 | | 3/2017 |

OTHER PUBLICATIONS

International Search Report and Written Opinion dated Oct. 28, 2016 issued in PCT/US16/47877.

"Summary of Disclosures and Products Sold Prior to Nov. 7, 2016," Bio-Rad Laboratories, Inc., Hercules, California, pp. 1.

"Yeti Cell Analyzer," (Brochure) CYTO Conference in Glasgow, Scotland, Jun. 26-30, 2015, Propel Labs, Inc., pp. 9.

"Yeti Cell Analyzer; Technology Advancements to Improve High Throughput Analysis," (PowerPoint Presentation) Inventor Daniel Nelson Fox of Propel Labs, Inc., Feb. 4, 2016, pp. 6.

"ZE5 Cell Analyzer Users Guide—Beta," (User Manual) Dec. 16, 2015, Propel Labs, Inc., pp. 12-13.

"Fast and Furious Floy Cytometry," (PowerPoint Presentation) Jul. 22, 2016, Inventor Daniel Nelson Fox of Propel Labs, Inc., pp. 5.

U.S. Appl. No. 15/354,462, filed Nov. 7, 2016, Gaskill-Fox et al.

Extended European Search Report dated Nov. 30, 2018, for EP Application No. 16839908.7.

* cited by examiner

Fig. 11A
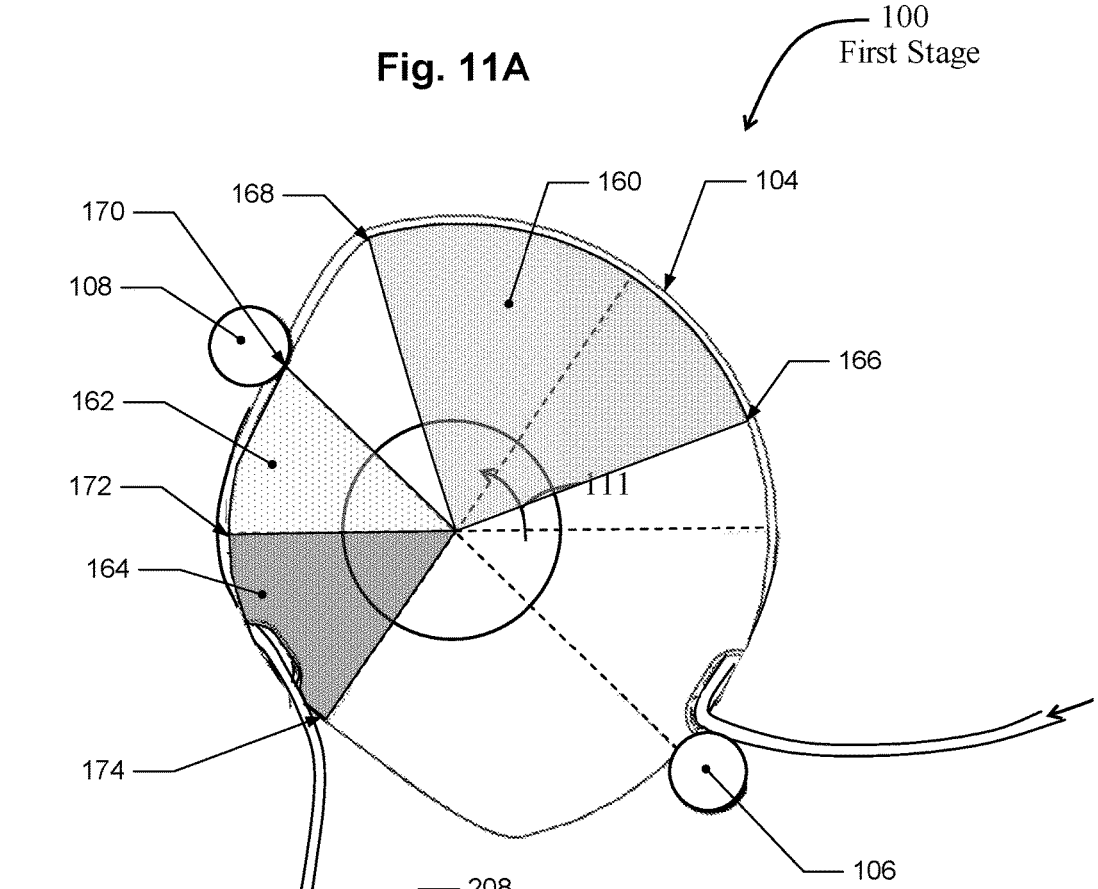
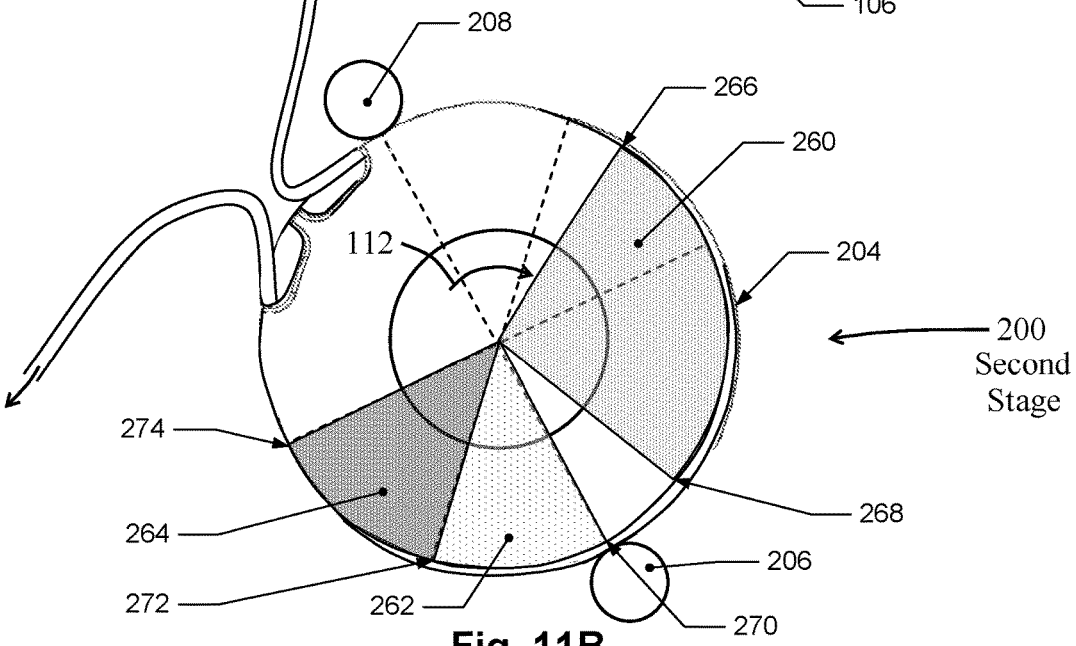
Fig. 11B

CONTINUOUS SAMPLE DELIVERY PERISTALTIC PUMP

CROSS REFERENCE TO RELATED APPLICATIONS

This application claims benefit of priority under 35 U.S.C. § 119(e) to U.S. Provisional Application No. 62/208,465 filed on Aug. 21, 2015, and titled "CONTINUOUS SAMPLE DELIVERY PERISTALTIC PUMP," which is hereby incorporated by reference herein in its entirety.

BACKGROUND

Various types of pumps exist for the purpose of pumping fluids, such as liquids. Pumps are used in numerous applications depending on the type of pump utilized. Many flow cytometers use peristaltic pumps, which have many advantages. Peristaltic pumps are positive displacement pumps. The fluid being pumped only contacts the flexible tubing and is not exposed to other pump components which could possibly cause cross-contamination. Both highly sterile fluids, as well as chemicals, can be pumped through the peristaltic pump, since the fluids only contact the flexible tubing. Peristaltic pumps are especially suited for pumping abrasives, viscous fluids and biological fluids.

SUMMARY

In one embodiment, a method of pumping a fluid through tubing that is positioned partially around the periphery of a first disk of a peristaltic pump and partially around the periphery of a second disk of the peristaltic pump may be provided. The method may include orbiting a plurality of first rollers at a constant angular speed around the periphery of the first disk such that the first rollers are constantly pressed into contact with the periphery of the first disk, the tubing, or the periphery of the first disk and the tubing. The first disk may include a first angular sector that is configured to cause the first rollers to move along a first section of the periphery of the first disk at a first tangential speed and a second angular sector that is configured to cause the first rollers to move along a second section of the periphery of the first disk at a second tangential speed less than the first tangential speed. The method may also include orbiting a plurality of second rollers at the constant angular speed around the periphery of a second disk such that the second rollers are constantly pressed into contact with the periphery of the second disk, the tubing, or the periphery of the second disk and the tubing. The second disk may be configured to cause each second roller to move at substantially the second tangential speed. The method may also include increasing the pressure of a portion of the fluid in the tubing between one first roller and one second roller by causing the one first roller to fully compress the tubing in the first angular sector and simultaneously causing the one second roller to fully compress the tubing in a first section of the periphery of the second disk and moving, after increasing the pressure of the portion of the fluid, the portion of the fluid through the tubing at a constant pressure towards an output of the tubing by causing the one first roller to fully compress the tubing in the second angular sector and simultaneously causing the one second roller to fully compress the tubing.

In some embodiments, the first disk may have a first nominal radius throughout at least part of the first angular sector and a second nominal radius throughout the second angular sector, the second disk may have the second nominal radius, and the first nominal radius may be larger than the second nominal radius.

In some such embodiments, the first disk may gradually transition in radius from the first radius to the second radius in between the first angular sector and the second angular sector.

In some embodiments, moving the portion of the fluid through the tubing at a constant pressure towards an output of the tube may further include causing, after the one first roller has moved along the second section of the periphery of the first disk, the one first roller to move along a third angular sector of the first disk that includes a third section of the periphery of the first disk, the one first roller to fully compress the tubing at at least the beginning of the third section, and the one first roller to not fully compress the tubing at at least the end of the third section of the periphery of the first disk. Moving the portion of the fluid through the tubing at the constant pressure towards an output of the tube may also include causing another second roller to fully compress the tubing against the second disk before causing the one first roller to not fully compress the tubing at at least the end of the third section of the periphery of the first disk. In such an embodiment, the first disk may be configured to cause the one first roller to move along the third section at the second tangential speed.

In some such embodiments, the method may further include causing another first roller to fully compress the tubing before causing the one first roller to not fully compress the tubing at at least the end of the third section of the periphery of the first disk.

In some other or additional such embodiments, the method may further include causing the one second roller to fully compress the tubing when the one first roller is at least at the beginning of the third section of the periphery of the first disk and not to compress the tube when the one first roller is at least at the end of the third section of the periphery of the first disk.

In some embodiments, there may be only two first rollers and only two second rollers.

In some embodiments, the method may further include drawing fluid into the tubing through an inlet by causing one of the first rollers to fully compress the tube and orbit around at least part of the periphery of the first disk.

In some embodiments, orbiting the plurality of first rollers at the constant angular speed around the periphery of the first disk and orbiting the plurality of second rollers at the constant angular speed around the periphery of the second disk may include fixing the first disk and the second disk in a position and causing the plurality of first rollers to orbit around the first disk and causing the plurality of second rollers to orbit around the second disk.

In some embodiments, the output may be configured to supply the fluid to one of a flow cell or a cuvette.

In some embodiments, the output of the tubing may have a pressure that substantially matches the constant pressure of the portion of the fluid.

In some embodiments, the output may be configured to supply the fluid to a nozzle of a flow cytometer.

In one embodiment, an apparatus may be provided. The apparatus may include a first disk that includes a first recess in the periphery of the first disk, the first recess configured to receive a first portion of tubing for conveying fluid; a first angular sector that has a nominal first radius and includes a first section of the periphery of the first disk; and a second angular sector that has a nominal second radius and includes a second section of the periphery of the first disk. In such an embodiment, the second radius may be smaller than the first radius, and the first section of the periphery of the first disk may be longer than the second section of the periphery of the first disk. The apparatus may also include a second disk that is substantially circular, has the nominal first radius, and includes a second recess in the periphery of the second disk, the second recess configured to receive a second portion of the tubing. The apparatus may also include a plurality of first rollers that are configured to orbit around the periphery of the first disk at a constant angular speed and that are also configured to, when the first portion of the tubing is in the first recess, constantly press into contact with the periphery of the first disk, the tubing, or the periphery of the first disk and the tubing. The apparatus may also include a plurality of second rollers that are configured to orbit around the periphery of the second disk at the constant angular speed and that are configured to, when the second portion of the tubing is in the second recess, constantly press into contact with the periphery of the second disk, the tubing, or the periphery of the second disk and the tubing. The first disk may be configured such that each first roller moves in the first angular sector at a first tangential speed while fully compressing the tubing and such that each first roller moves in the second angular sector at a second tangential speed while fully compressing the tubing, whereas the second disk may be configured such that each second roller moves around the periphery of the second disk at the second tangential speed. The first disk, second disk, first rollers, and second rollers may be configured to cause one first roller to fully compress the tubing while moving in the first angular sector and to simultaneously cause one second roller to fully compress the tubing while moving in a first section of the periphery of the second disk, and the first disk, second disk, first rollers, and second rollers may be further configured to cause, after the one first roller has moved past the first angular sector, the one first roller to fully compress the tubing in the second angular sector and to simultaneously cause the one second roller to fully compress the tubing.

In some embodiments, the first disk may gradually transition in radius from the first radius to the second radius in between the first angular sector and the second angular sector.

In some embodiments, the first disk may be further configured to cause, after the one first roller has moved along the second section of the periphery of the first disk, the one first roller to move along a third angular sector of the first disk that includes a third section of the periphery of the first disk. The first disk may be further configured to cause the one first roller to move along the third section at the second tangential speed, the one first roller to fully compress the tubing at at least the beginning of the third section, and the one first roller to not fully compress the tube at at least the end of the third section. The second disk may be further configured to cause another second roller to fully compress the tubing against the second disk before the one first roller is caused to not fully compress the tubing at at least the end of the third section of the periphery of the first disk.

In some embodiments, the apparatus may further include a first roller support on which the first rollers are mounted and a second roller support on which the second rollers are mounted. The first roller support and the second roller support may be configured to rotate about a common center axis at the constant angular speed.

In some embodiments, the apparatus may further include the tubing that is positioned partially around the periphery of the first disk in the first recess and that is positioned partially around the periphery of the second disk in the second recess.

In some embodiments, in the sections of the periphery of the first disk where the first rollers fully compress the tubing, the first recess may have a first depth that is less than the nominal outer diameter of the tubing, causing the tubing to extend past the periphery of the first disk such that the first rollers fully compress the tubing, and in the sections of the periphery of the second disk where the second rollers fully compress the tubing, the second recess may have a second depth that is less than the nominal outer diameter of the tubing and that causes the tubing to extend past the periphery of the second disk such that the second rollers fully compress the tubing.

In some embodiments, the first disk may include a first adjustment plate and the adjustment plate may be movable with respect to the remainder of the first disk such that locations along the periphery of the first disk where full compression of the tubing occurs between the first disk and a first roller are tunable.

In some embodiments, the second disk includes a second adjustment plate and the adjustment plate may be movable with respect to the remainder of the second disk such that locations along the periphery of the second disk where full compression of the tubing occurs between the second disk and a second roller are tunable.

In another embodiment, a method of reducing pressure variations of a fluid that is pumped through a peristaltic pump may be provided. The method may include creating a supply of pressurized fluid in a first stage of the peristaltic pump using a first disk to pressurize the fluid by causing first rollers to move at different speeds around a periphery of the first disk, pumping the pressurized fluid in a second stage of the peristaltic pump using a second disk to move the pressurized fluid to an output at a substantially constant pressure by causing second rollers to move at substantially equal speeds around a periphery of the second disk.

In some embodiments, the first rollers may pivot around the first disk at a substantially constant angular rotational speed. The first disk may have different radii at different angular locations on the first disk, which causes the first rollers to traverse longer and shorter paths around the periphery of the first disk, which causes the first rollers to traverse the periphery of the first disk at different speeds.

In some embodiments, the second rollers may pivot around the second disk at a substantially constant angular rotational speed, the second disk being substantially round so that the second rollers traverse around the periphery of the second disk at a substantially constant peripheral speed.

In one embodiment, a peristaltic pump that produces an output flow of fluid at a substantially constant output pressure may be provided. The peristaltic pump may include a first section of flexible tube and a first disk. The first section of flexible tube may be disposed in a recess in the first disk and wrapped around a peripheral portion of the first disk such that the first section of flexible tube protrudes from the recess at first predetermined locations around the periphery of the first disk and does not protrude from the recess at second locations around the peripheral portion of the first disk. The first disk may also have different radii that extend from a pivot point on the first disk to the peripheral portion at different angular locations on the first disk. The pump may also include first rollers that are biased against the peripheral portion of the first disk and that compress the first section of flexible tube wrapped around the peripheral portion of the first disk at the first predetermined angular locations, the first rollers being mounted to rotate around the pivot point at a substantially constant angular rotational speed so that the first rollers traverse shorter and longer paths around the periphery of the first disk, which causes the first rollers to traverse the periphery of the first disk at different speeds and thereby causes the fluid to be pressurized to create a pressurized fluid that flows from the first disk. The pump may also include a second section of flexible tube and a second disk having a round shape and a pivot point at a center of the round shape. The second section of flexible tube may be disposed in a recess in the second disk and wrapped around a peripheral portion of the second disk such that the second section of flexible tube protrudes from the recess at first predetermined locations around the peripheral portion of the second disk and does not protrude from the recess at second predetermined locations around the periphery of the second disk. The pump may also include second rollers that are biased against the peripheral portion of the second disk that compress the second section of flexible tube wrapped around the peripheral portion of the second disk at the first predetermined locations around the periphery of the second disk, and the second rollers may be mounted so as to rotate around the pivot point of the second disk at a substantially constant angular rotational speed so that the second rollers move at a substantially constant speed on the peripheral portion of the second disk and generate an output flow of the fluid that has a substantially constant output pressure.

In some embodiments, the peristaltic pump may include first adjustment plates disposed on the first disk adjacent to the peripheral portions of the first disk that provide an adjustment of the first predetermined locations where the first and second sections of flexible tube protrudes from the recess.

In some further embodiments, the peristaltic pump may further include second adjustment plates disposed on the second disk adjacent to the peripheral portion of the second disk that provide an adjustment of the first predetermined locations around the peripheral portion of the second disk.

BRIEF DESCRIPTION OF THE DRAWINGS

FIGS. 11A and 11B are schematic illustrations of FIGS. 3A and 3B.

DETAILED DESCRIPTION OF THE EMBODIMENTS

Figure 1:
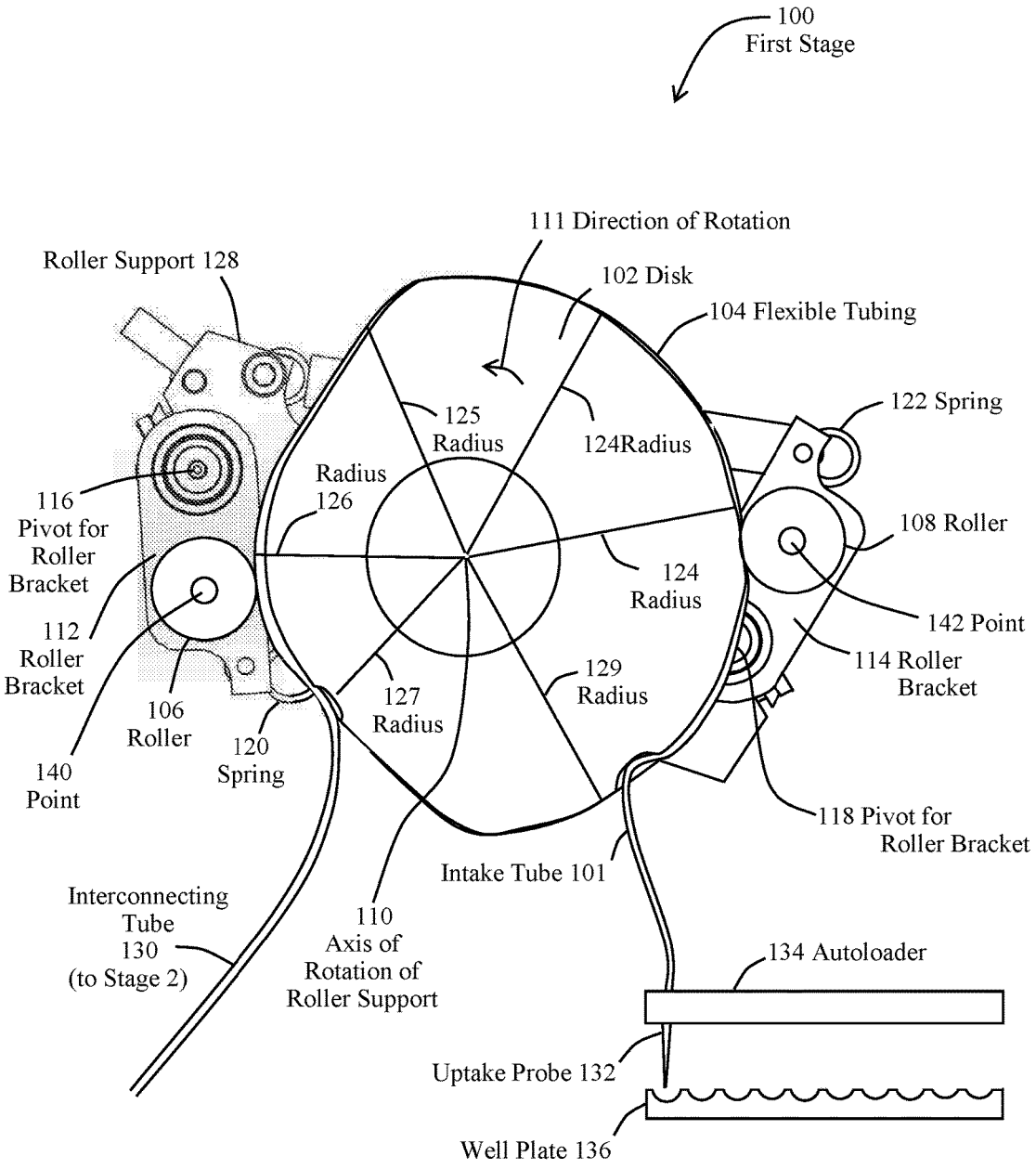
FIG. 1 is a schematic diagram of the first stage of an embodiment of a peristaltic pump.

FIG. 1 is a schematic illustration of the first stage 100 of an embodiment of a peristaltic pump. As illustrated in FIG. 1, the first stage 100 of the peristaltic pump includes a first disk 102 having an irregular shape. As used herein, "disk" is used to refer to both a round disk and a non-round cam, and such items may have a circular or partially circular shape, as can be seen in FIG. 1. An intake tubing 101 is connected to an auto loader 134 that has an uptake probe 132. The word "tubing," as used herein, may refer to discrete sections of tubing that are joined together, e.g., via couplers, or a single length of unbroken tubing; it may also refer to different portions of such structures. The autoloader 134 moves the uptake probe 132 to the wells that are formed in the well plate 136 (or other media and containers) to obtain biological samples that are then pumped through the peristaltic pump. FIG. 1 is but one example of the application of a peristaltic pump; it may be used in other contexts as well aside from a flow cytometer.

Figure 2:
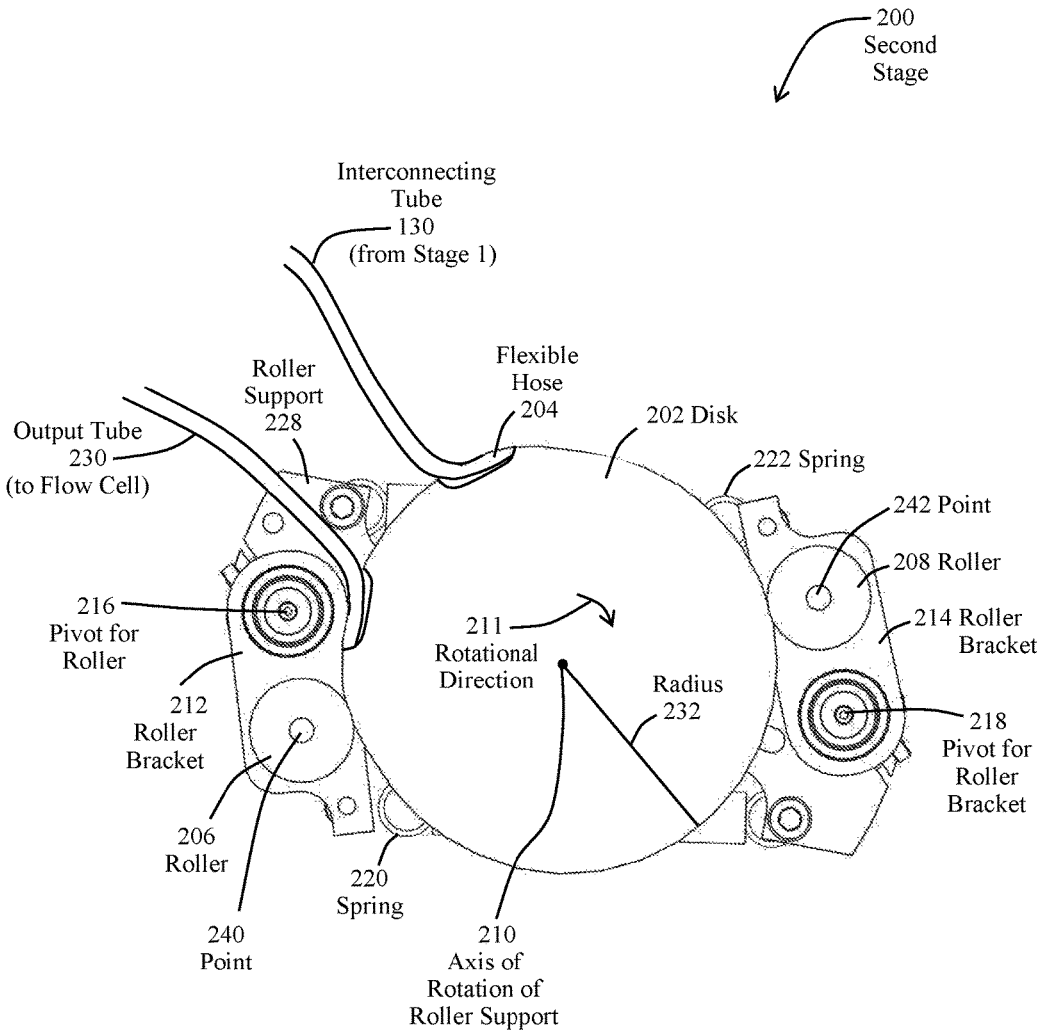
FIG. 2 is a schematic top diagram of the second stage of an embodiment of a peristaltic pump.

The peristaltic pump disclosed herein has two stages, the first stage 100 that is illustrated in FIG. 1, and a second stage 200 that is illustrated in FIG. 2. An advantage of peristaltic pumps is that the fluid that is being pumped through a peristaltic pump does not touch any of the pump parts except for the flexible tubing, such as intake tubing 101 and flexible tubing 104. In a conventional peristaltic pump, the tubing is wrapped around a disk or cam and two or more spring-loaded rollers are orbited around the disk or cam so that the tubing is compressed against the disk or cam. The rollers, as they compress the tubing against the disk or cam during their orbit of the disk or cam, force or squeeze the fluid through the tubing. In this manner, the fluid that is being pumped through the peristaltic pump can avoid being contaminated. A disadvantage, however, of conventional peristaltic pumps is that the output pressure of the liquid varies substantially, such that the output is a pulsed output that pulses with the rotational speed of the peristaltic pump. In many applications, a pulsed output with varying output pressure of the fluid is unacceptable. For example, the present inventors have found that in a flow cytometry context, pulsations of fluid flow adversely affect flow cytometry data because such pressure fluctuations can cause the sample volume to fluctuate within the flow cell where flow cytometry measurements occur, thereby making it more difficult to properly quantify the number of particles or cells in the sample. Some peristaltic pumps attempt to reduce this pulsation by using three or more rollers to average out or smooth out the pulsations, but the additional rollers decrease the lifespan of the flexible tubing of the peristaltic pump thereby leading to increased maintenance costs and pump downtime. For example, the tubing will experience 50% more wear and tear with three rollers instead of two.

In view of the issue with pulsation in the flow cytometry context, a substantially constant output pressure is desirable in many flow cytometry applications. The pulsing of the output liquid from a conventional peristaltic pump may be acceptable in many instruments and other applications. However, it would be much more desirable to have a substantially constant pressure output that does not pulse in many other applications of a peristaltic pump, e.g., in flow cytometers.

Additionally, because samples in flow cytometry may be taken from small volume containers, such as a 5 milliliter tube or 96-well plate, it is more difficult and complex to use an air compression pump that utilizes a seal with such containers. Syringe pumps may also be used for flow cytometry, but such pumps are slow, have functional problems, are difficult to clean out or de-clog, and are unable to effectively draw samples of varying media and/or varying volumes.

The embodiments disclosed herein relate to a two-stage peristaltic pump that provides a substantially constant output pressure of the liquid being pumped through the peristaltic pump. The first stage 100 is used to increase the pressure of the liquid in the tubing above the inlet pressure and both the first stage 100 and the second stage 200 pump, e.g., move, the liquid through the tubing to an output of the tubing. When the two stage peristaltic pump disclosed herein is used in an application which provides back pressure, i.e., pressure that is higher than the inlet pressure, to the output of the tubing, the pump is configured to provide a substantially constant pressure which matches or exceeds the back pressure in order to prevent the fluid from flowing backward, into, and through the pump.

Referring back to FIG. 1, first stage 100 includes the first disk 102, a plurality of first rollers 106, 108 (as discussed herein, the first disk and the second disk each have two rollers but additional rollers may be used; two rollers per disk results in the longest lifespan of the tubing by a significant margin, as discussed elsewhere herein), and flexible tubing 104 (a.k.a., "tubing" or "tubing 104"). As discussed in greater detail below, the first rollers 106, 108 orbit around the periphery of the first disk 102 at a constant angular speed and during the orbit, each roller is caused to contact the periphery of the first disk 102, the tubing 104, or the periphery of the first disk 102 and the tubing 104, such that in various locations around the periphery of the first disk 102 one or more of the first rollers fully compresses the tubing 104. It should be noted that such orbiting of rollers (i.e., the first and the second rollers) may also be referred to herein as the rollers rotating around or about the first disk; such orbiting also means the movement of rollers around, or encircling, the periphery of a disk. Such orbiting or movement around the periphery of a disk is not intended to mean the rotation of each roller around each roller's individual pivot point, as discussed below, although the rollers may typically rotate about their own centers as they orbit the disk and roll along the periphery of the disk. Therefore, as each roller orbits around the periphery of the disk, each roller is also simultaneously rotating about its own pivot point.

As seen in FIG. 1, the flexible tubing 104 is wrapped around the majority of the outside perimeter, i.e., the periphery, of the first disk 102. As illustrated in more detail below with respect to FIGS. 6-9, the flexible tubing 104 is positioned in a recess, i.e., a trough, such that in certain positions around the periphery of the first disk 102, the tubing 104 extends past the periphery of the first disk 102 to enable the first rollers 106, 108 that orbit, i.e., rotate, around the periphery of the first disk 102 to compress the flexible tubing 104 in such locations; such compression of the tubing by the first rollers 106, 108, depends upon the depth of the trough or placement of the adjustment plate, as explained in more detail below.

As also seen in FIG. 1, roller support 128 is attached to roller brackets 112, 114 and causes the first rollers 106, 108 to rotate around the first disk 102 in a counterclockwise direction, as illustrated by arrow 111 in FIG. 1. The first rollers 106, 108 are forced against the periphery of the first disk 102 by springs 120, 122, respectively, so that the flexible tubing 104 is compressed against the first disk 102 in locations where the flexible tubing 104 is exposed to rollers 106, 108. Roller brackets 112, 114 pivot around pivots 118, 116, respectively, that are mounted on the roller support 128. First rollers 106, 108 rotate about points 140 and 142 as they roll along the outer periphery of the first disk 102 during their orbits of the first disk 102.

As also illustrated in FIG. 1, the axis of the rotation 110 of the roller support 128 is located so that radii 124, 125, 126, 127, 129 exist between the axis 110 and the periphery of the first disk 102. As such, the radii, e.g., radius 124, 125 and 129, are greater than radii 126 and 127. Because of this, the first rollers 106, 108 move at a higher tangential speed along the periphery of the first disk 102 at radii 124, 125, 129 than at radii 126, 127 for a given angular velocity of the roller support 128. Accordingly, as discussed below, when fluid in the tubing is trapped between two rollers (e.g., two first rollers or a first roller and a second roller) and the rear roller, i.e., the roller closer to the intake tube, is moving at a greater tangential speed than the front roller, i.e., the roller further from the intake tube, the length of the tubing containing the fluid is decreased, but because the fluid is incompressible, the volume of the fluid remains constant and forces the tubing to expand to accommodate this fluid volume which in turn increases the pressure of the trapped fluid in the tubing between these two rollers. It is this process that is used by the peristaltic pump disclosed herein to increase the pressure of a fluid flowing through the pump.

FIG. 2 is a schematic top view of the second stage 200 of the peristaltic pump. As can be seen, the second stage 200 includes a second disk 202 and second rollers 206, 208 and roller support 228 on which the second rollers 206, 208 are mounted; roller support 228 is configured to rotate in a clockwise direction around the second disk 202, as illustrated by arrow 211. Roller support 228, in the illustrated embodiment, rotates in the same direction and same angular speed as roller support 128; alternatively, the two roller supports may not be connected with one another, but may be driven at the same angular speed and in the same angular direction, e.g., by a common motor via two separate belt drives. FIG. 2 illustrates the second stage 200 from a top perspective. Accordingly, the first stage 100, when viewed from a bottom perspective, moves in a counterclockwise direction, while the second stage, which is rotating in the same direction, is rotating in a clockwise direction when viewed from the top. In order to coordinate the functions of the first stage 100 and the second stage 200, the rotation of the roller support 228 and the rotation of the roller support 128, of FIG. 1, are synchronized and, in this embodiment, rotate at the same rotational, i.e. angular, speed and in the same direction.

In FIG. 2, rollers 206, 208 are mounted on roller brackets 214, 212, respectively, and are biased against the outer periphery of the second disk 202 by springs 222, 220, respectively. As the roller support 228 rotates the second rollers 206, 208 in a clockwise direction, as shown by arrow 211, rollers 206, 208 roll along the periphery of the second disk 202 and rotate around points 240 and 242, respectively, thereby squeezing or compressing the flexible hose 204 at locations along the periphery of the second disk 202 where the flexible hose 204 is exposed to the surface of the second rollers 206, 208. The fluid in tubing 204 that is in front of a second roller, i.e., located on the side of the roller further from the tubing inlet, is pumped by the second stage 200 by the rotation of the roller support 228 around the second disk 202 to move the second rollers 206, 208 such that the fluid moves through the flexible hose 204 around the periphery of the second disk 202 until the fluid exits the an output 230 of the tubing, which may be connected to a flow cell in a flow cytometer or a nozzle of a flow cytometer. Of course, the fluid can be pumped into any device for use and does not necessarily need to be pumped into a flow cytometer. The fluid in the second stage 200 that is in front of each of the second rollers 206, 208 (e.g., being pushed by each second roller) is not subjected to a pressure increase but is simply moved towards the output of the tubing at a constant pressure. Back pressure of the system to which the fluid is being applied assists in maintaining a substantially constant pressure of the fluid pumped from the second stage.

As indicated above, the second rollers 206, 208 are biased against (i.e., constantly pressed into contact with) the periphery of the second disk 202, tubing 204, or the periphery of the second disk 202 and tubing 204 by springs 222, 220. The roller brackets 212, 214 pivot around pivots 216, 218, respectively. Unlike the first disk 102 of FIG. 1, the second disk 202 has a substantially constant radius 232 so that the second rollers 206, 208 move at substantially the same tangential speed (there may be some minor variation in tangential speed of the rollers due, for example, to shifts in roller position due to the amount of tubing compression by the second rollers; generally speaking, the second rollers will be kept at the same nominal speed) around the periphery of the second disk 202. As such, the pressure of the pumped fluid (e.g., the fluid that is pushed by each second roller 206, 208 towards the output of the tubing) remains substantially the same as the fluid is pushed around the second disk 202 by the second rollers.

Figures 3A, 3B:
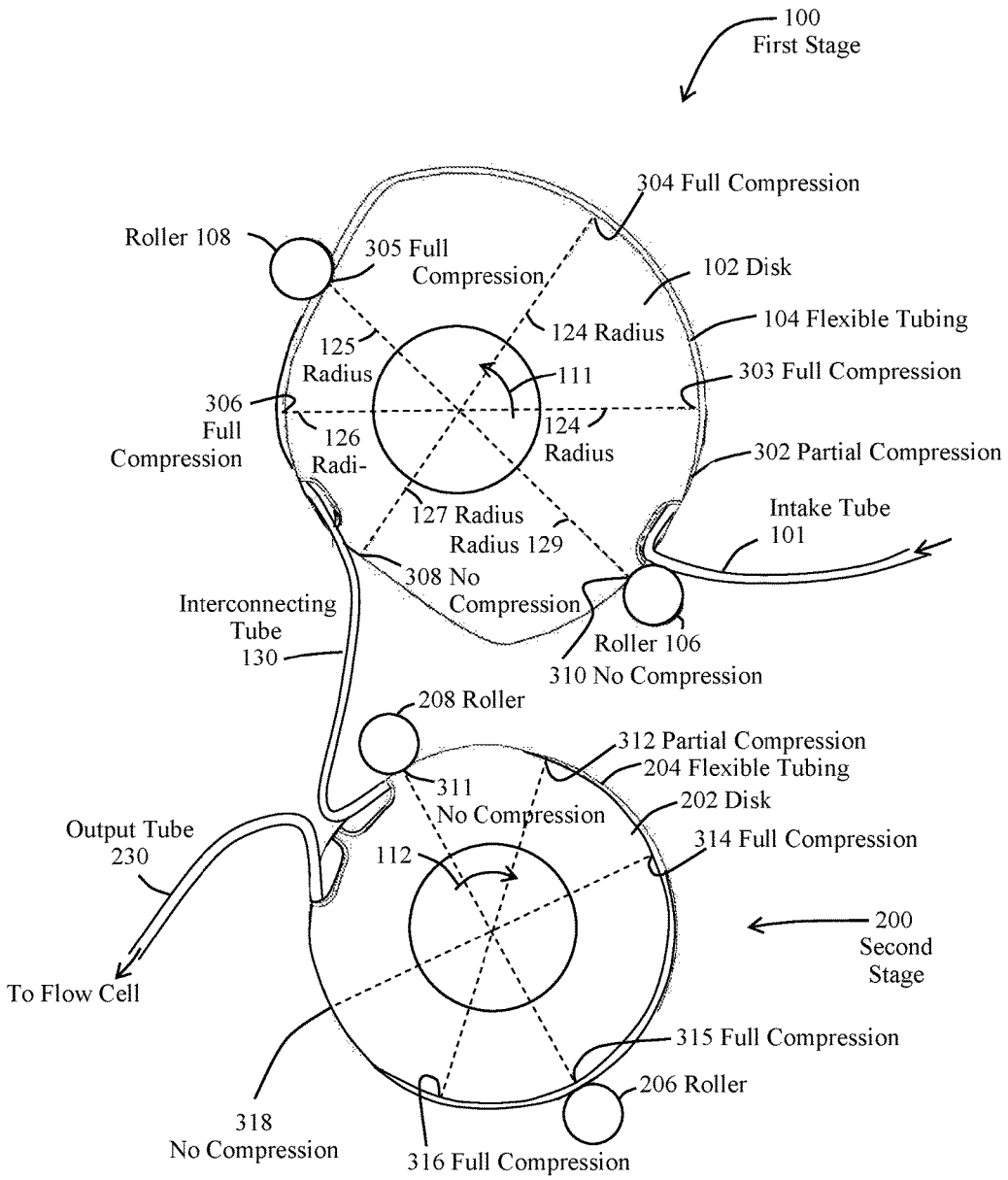
FIGS. 3A and 3B are schematic diagrams illustrating initial positions of rollers on a disk for both the first stage and the second stage of the peristaltic pump.

FIGS. 3A, 3B, 4A, 4B, 5A and 5B illustrate the operation of the first stage 100 and the second stage 200 of the peristaltic pump as the first and second rollers proceed around, i.e., orbit, the peripheries of the first and second disks, respectively. As shown in FIG. 3A, first rollers 106, 108 are located in a first position 310 around the first disk 102. First rollers 106, 108 rotate in a counterclockwise direction, as indicated by arrow 111. The first stage 100 has a flexible tubing 104 that is wrapped around the majority of the outside periphery of the first disk 102. The irregular shape of the first disk 102 results in radii 124 and 129 having different lengths than radii 125, 126, and 127. As mentioned above, first roller support 128 (not pictured) rotates around the axis 110 and supports roller bracket 112 and roller bracket 114. Roller bracket 112 pivots around pivot 116, while roller bracket 114 pivots around pivot 118. Springs 120 and 122 bias rollers 106 and 108, respectively, to contact the periphery of the first disk 102, the tubing 104, or the periphery of the first disk 102 and the tubing 104.

In operation, the roller support 128 rotates the first rollers 106, 108 around the first disk 102 in the direction of rotation 111, i.e., counterclockwise, as viewed from the bottom. Because of the irregular shape of the first disk 102, the first rollers 106, 108 travel at different tangential speeds around the periphery of the first disk 108 because the roller support 128 moves at a constant angular rotational speed and the first rollers 106, 108 traverse the periphery of disk 102 at different radii 124, 125, 126, 127 and 129. As used herein, the term "tangential speed" refers to the relative speed between a roller and the surface it is rolling along. For example, if a 1 inch diameter roller is rolling along a portion of the periphery of the first disk that has a radius of 4 inches and the support arm driving that roller is rotating at a speed of 30°/second, the tangential speed or velocity of the roller at the roller center would be $2\pi\cdot$(local disk radius+distance from disk periphery to roller center)$\cdot 30°/\text{second}/360° = 2\pi\cdot 4.5\cdot 1/12$ inches/second=2.35 inches/second. If that same roller is rolling along a portion of the periphery of the first disk that has a radius of 2 inches and the support arm is rotating at the same speed, however, the tangential speed or velocity of the roller at the roller center would be $2\pi\cdot 2.5\cdot 1/12$ inches/second=1.31 inches/second. Thus, when the first rollers 106, 108 traverse around the periphery of the first disk 102 where the radius is shown as radius 124 and radius 129, the tangential speed of the first rollers 106, 108 on the periphery of the first disk 102 is greater than the tangential speed of the first rollers when they are traversing the periphery of the first disk 102 at radii 125, 126, and 127. Since the first rollers 106, 108 move faster in the areas where the radius is greater, the first rollers 106, 108 move along the flexible tubing 104 in these areas at a greater rate of speed. Conversely, when the first rollers 106, 108 are moving along the periphery of disk 102 on portions of the first disk 102 that have a shorter radius, such as radii 126, 127, the first rollers 106, 108 move in these areas at a slower rate of speed along the flexible tubing 104. When both first rollers 106, 108 are compressing the flexible tubing 104, and one of the first rollers is moving faster on the periphery of first disk 102 than the other first roller, the fluid trapped in the tubing between first rollers 106 and 108 experiences a pressure increase.

As the first roller support 128 rotates around the first disk 102 at a constant angular rotational speed, the first rollers 106, 108 are biased against the periphery of the first disk 102, the tubing 104, or the periphery of the first disk 102 and the tubing 104, and cause the flexible tubing 104 to experience various states of compression at various locations around the periphery of the first disk 102. Fluid from the intake tubing 101 is drawn into the flexible tubing 104 as the first rollers 106, 108 move in a counterclockwise direction 111 and fully compress the flexible tubing 104. Fluid is thus drawn from the intake tubing 101 and is forced out of the interconnecting tubing 130 and proceeds to the second stage that is illustrated in FIG. 2.

As seen in at least FIGS. 3A and 3B, interconnecting tubing 130 extends from the first stage 100, proceeds to the second disk 202, and is wrapped around part of the periphery of the second disk 202 in a clockwise direction. Disk 102 and second disk 202 may be aligned with each other as discussed herein, although it is to be understood that there may be many other arrangements of the first and second disks that may still provide the same functionality as is discussed herein. For example, both disks may actually be arranged as depicted in FIGS. 3A and 3B (side-by-side), but with the second disk and rollers flipped over so that the direction of rotation of the roller support 228 rotates in the same direction as the roller support 128—both roller supports 128 and 228 may be driven by the same drive system and the rollers and tubing may operate in effectively the same way as is described herein with regard to the depicted example.

First roller support 128 rotates around the first disk 102 (as shown in FIG. 1) synchronously with second roller support 228, which rotates round second disk 202. Consequently, the rotational phase of the first rollers 106, 108 and the second rollers 206, 208 remains constant. As discussed above, the roller supports of the first stage 100 and the second stage 200 rotate in the same direction, even though arrow 111 indicates a counterclockwise rotation and arrow 211 indicates a clockwise rotation. Again, this is because FIGS. 1 and 3A are bottom views of the peristaltic pump and FIGS. 2 and 3B are top views of the peristaltic pump.

As illustrated in at least FIGS. 2 and 3B, the second disk 202 has a substantially constant radius 232 (e.g., within ±1% or ±5% of round; 1% or less may result in the least amount of pressure variation in the fluid that gets trapped between the second rollers as they orbit the second disk). The flexible tubing 204 is wrapped around the majority of the periphery of the second disk 202 so that the second rollers 206, 208 can compress the flexible tubing 204 along portions of the periphery of the second disk 202 that are exposed to the second rollers 206, 208, such as the portions including locations 314, 315, and 316. The fluid enters the flexible tubing 204 from interconnecting tubing 130 from the first stage 100. As discussed below, the pressure of the fluid is increased while partially located in both the first and second stages between a first roller and a second roller that are both fully compressing the tubing. Second rollers 206, 208 are mounted on roller brackets 212, 214, respectively. As stated above, roller brackets 212, 214 rotate on pivots 216, 218, respectively, and springs 220, 222 constantly press the second rollers 206, 208 into contact with the periphery of the second disk 202, the tubing 204, or the periphery of the second disk 202 and the tubing 204.

Referring back to FIG. 3A, first roller 106 is located at position 310 on the outer periphery of the first disk 102 where there is no compression of the tubing 104 because at this location the first disk 102 is configured such that the flexible tubing 104 is not exposed to the pressure of the first roller 106. In fact, the flexible tubing 104 is not even disposed along the periphery of the first disk 102 at location 310. Uptake tubing 101, as described above, provides intake fluid to the flexible tubing 104. The flexible tubing 104 is wrapped around the periphery of the first disk 102 from the uptake tubing 101, counterclockwise around the periphery of the first disk 102 to the interconnecting tubing 130. At various locations along the periphery of the first disk 102, the flexible tubing 104 will be exposed to, partially exposed to, or not exposed to the pressure of the first rollers 106, 108, which results in the flexible tubing 104 being fully compressed, partially compressed or not compressed, as explained in more detail below.

As also shown in FIG. 3A, roller 108 contacts the first disk 102 at location 305 and fully compresses the flexible tubing 104. The labels of locations 303, 304, 305 and 306, the flexible tubing 104 indicate that tubing 104 is fully compressed by the first rollers 106, 108 at these locations. At locations 308 and 310, there is no compression of the flexible tubing 104 by the first rollers 106, 108. At location 302, the tubing 104 is partially compressed.

As further illustrated in FIG. 3A, the first disk 102 has various length radii. For instance, the first disk 102 has longer radii 124 and 129 (e.g., longer radii in at least the regions between positions 310 and 304, in a clockwise direction from position 310) which cause the first rollers 106, 108 to move at a faster tangential speed along the peripheral surface of the first disk 102 at and between these positions. Radii 125, 126, and 127 are shorter than the radii 129, 124, such that the first rollers 106, 108 do not move as quickly along the peripheral surface of the first disk 102 for these radii. For example, first roller 106 moves at a faster tangential speed as it moves in the clockwise direction (with the roller support maintaining a constant rotational speed) from position 310 (having radius 129) to position 303 (having radius 124) than its tangential speed as it moves from position 305 (having radius 125) to position 306 (having radius 126, which in some embodiments may be the same length as radius 126) because the radii at positions 305 and 306 are shorter than the radii between positions 310 and 303.

As additionally illustrated in FIG. 3A, when the first rollers 106, 108 are at locations 310, 305, respectively, first roller 106 is not compressing the flexible tubing 104, while first roller 108 is fully compressing the flexible tubing 104. As such, when first roller 108 moves into the position 305, roller 108 is drawing fluid from the intake tubing 101, since the flexible tubing 104 is not compressed by first roller 106, i.e., at these positions the first roller 106 does not affect the fluid flow within the tubing. First roller 108 continues to draw fluid through the intake tubing 101, as it rotates counterclockwise around the periphery of the first disk 102 through position 306 until first roller 106 starts fully compressing flexible tubing 104 between positions 302 and 303. It should be noted that the first disk 102 and first rollers are configured such that as one first roller moves from position 306 to position 308, that first roller does not stop fully compressing the tubing until after the other first roller is fully compressing the tubing.

FIG. 3B illustrates the operation of the second stage 200. When first rollers 106, 108 are in the locations illustrated in FIG. 3A, second rollers 206, 208 are located in the corresponding positions illustrated in FIG. 3B on the periphery of the second disk 202. For instance, second roller 208 is located at position 311 and is not compressing flexible tubing 204. Second roller 206 is at position 315 and is fully compressing the flexible tubing 204. As such, fluid trapped between first roller 108 at position 305 and the second roller 206 at position 315 is moved by first roller 108 and second roller 206 towards the output tubing 230 through the interconnecting tubing 130 and through the flexible tubing 204. As the first roller 108 moves from position 305 to 306, it is moving at the same tangential speed as the second rollers 206, 208 because the radius of disk 102 at positions 305 through 308 is substantially the same as the radius of the second disk 202. Accordingly, the first roller 108 pushes (and the second roller 206 pulls at the same rate) and causes the fluid in the tubing 104 to move from position 305 towards the second disk 202 without increasing the pressure of the fluid trapped between first roller 108 and the second roller 206 as they move between these positions (i.e., 305 to 306 and 315 to 316, respectively). This constant-pressure movement of the fluid trapped between the first roller 108 and the second roller 206 continues until the first roller 108 no longer fully compresses the tubing, at which point the fluid is no longer trapped between the first roller 108 and the second roller 206. However, before the first roller 108 stops fully compressing the tubing, the second roller 208 will start fully compressing the tubing, and the portion of the fluid in front of the second roller 208 will continue to be moved at constant pressure towards the outlet. At position 312 of disk 202, there is partial compression of the flexible tubing 204 by a second roller and at position 314, there is full compression of flexible tubing 204 by a second roller; the second roller transitions to full compression at some point between positions 312 and 314.

As indicated above, at position 315, there is full compression of the flexible tubing 204 against the second disk 202. At position 316, there is still full compression of the flexible tubing 204 and at position 318 there is no compression of the flexible tubing 204 by the second rollers 206, 208. Flexible tubing 204 is fluidically connected to the output tubing 230, which delivers fluid to a flow cell an embodiment in which the peristaltic pump is used in a flow cytometer. In some alternative embodiments, the output tubing 230 is fluidically connected to a nozzle of a flow cytometer and the output pressure of the output tubing 230 may be governed by the pressure of the fluid within the nozzle. In other implementations, output tubing 230 simply comprises the output of the second stage 200 of the peristaltic pump. As indicated in FIG. 3B, the second rollers 206, 208 rotate, i.e., orbit, around the periphery of the second disk 202 in a clockwise direction, either compressing, partially compressing, or not compressing the flexible tubing 204 in at least the positions indicated in FIG. 3B.

Figures 4A, 4B:
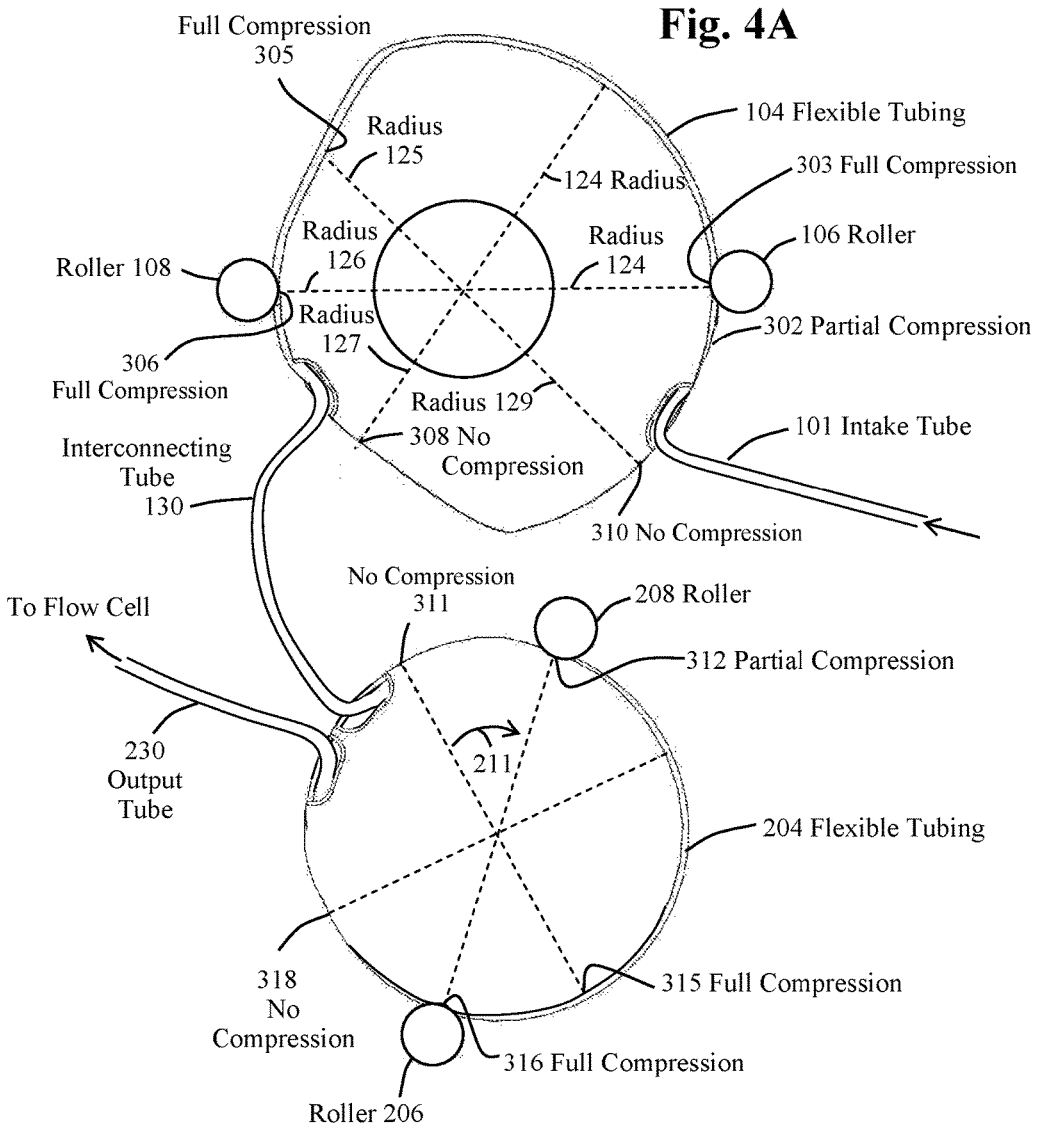
FIGS. 4A and 4B are schematic illustrations of a second location of rollers on the disks of an embodiment of the first stage and the second stage.

FIG. 4A is a schematic illustration of the first stage 100 of the peristaltic pump with the first rollers 106, 108 in a second position. First roller 106 has moved from position 310 to position 303 where the first roller 106 is fully compressing the flexible tubing 104. Similarly, first roller 108 has moved in a counterclockwise direction from position 305, where the first roller 108 was fully compressing the flexible tubing 104, to position 306, where there is still full compression of the first roller 308 on the flexible tubing 104. During the movement of first roller 106 from position 310 to position 303, and the movement of first roller 108 from position 305 to position 306, first roller 106 starts compressing and then fully compresses the flexible tubing 104 which causes a portion of fluid to be trapped between first rollers 106 and 108; this trapped portion of fluid will experience a pressure increase as the first rollers continue to advance while both first rollers fully compress the tubing. At the point depicted, the fluid that is trapped between the first roller 108 and the second roller 206, which includes the fluid in the interconnecting tubing 130, is already pressurized to the final output flow pressure. Subsequently, second roller 208 transitions to full compression of the tubing while second roller 206 is fully compressing the tubing.

FIG. 4B is a schematic illustration of the second stage 200 of the peristaltic pump. Second roller 208 has moved from position 311, where there was no compression of tubing 204, in a clockwise direction, to position 312, where there is partial compression of tubing 204. Similarly, second roller 206 has moved from position 315, where there is full compression of tubing 204, to position 316, where there is also full compression of tubing 204. Here, first roller 108 is pushing, i.e., moving, the liquid in tubing 104 through tubing 104, tubing 130, and tubing 204 as it advances from position 305 to position 306 and going at the same tangential speed as second roller 206 because radii 125 and 126 are substantially the same as the radius of the second disk 202. This prevents the pressure of this portion of fluid from increasing and instead causes the pressure to remain substantially constant during movement of this portion of the fluid.

Figures 5A, 5B:
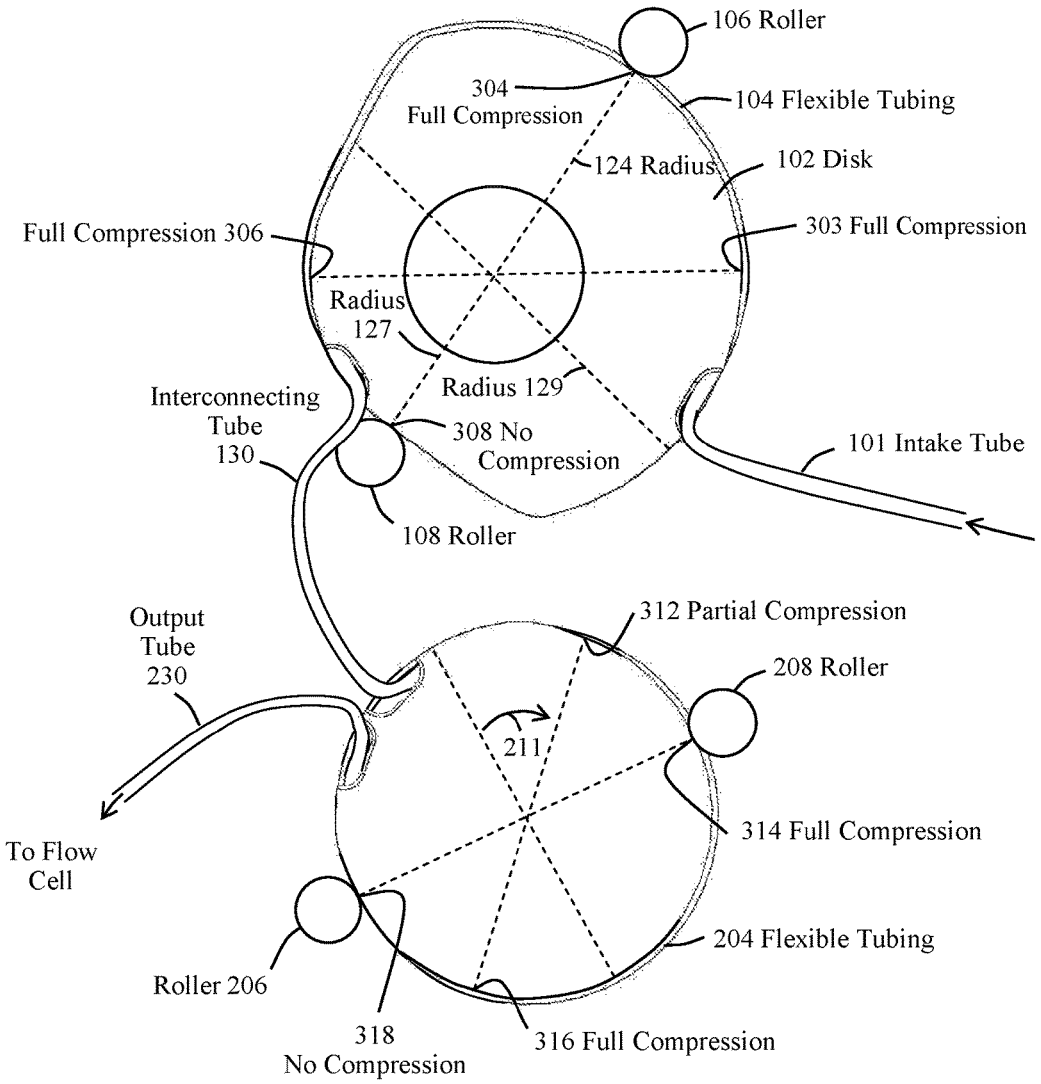
FIGS. 5A and 5B are schematic illustrations of the third location of rollers on the disks of an embodiment of the first stage and the second stage.

FIG. 5A is a schematic top view of the first stage 100 of the peristaltic pump illustrating first rollers 106, 108 in a third position. As illustrated in FIG. 5A, first roller 106 has moved in a counterclockwise direction, as indicated by arrow 111, from position 303, where there was full compression of tubing 104, to position 304, where there is also full compression of the flexible tubing 104. First roller 108 has moved from position 306, where there was full compression of the flexible tubing 104, to position 308, where there is no compression of the flexible tubing 104. As discussed below, the pressure of the fluid trapped between the first rollers 106, 108 as one of the first rollers moves from position 303 to 304 and the other first roller simultaneously moves from position 306 to 308 may increase because the roller moving from position 303 to 304 is moving at a faster tangential speed than the roller moving from position 306 to 308. In some embodiments, this pressure increase may be negligible, e.g., if one first roller starts fully compressing the tubing just before the other first roller stops fully compressing the tubing. However, after a first roller stops fully compressing the tubing, e.g., between locations 306 and 308, the fluid trapped between the other first roller and one of the second rollers may be further pressurized as those rollers continue to traverse the periphery of their respective disks—indeed, the bulk of the pressure increase that is experienced by the fluid may occur while the fluid is trapped between one of the first rollers and one of the second rollers. Accordingly, the fluid between the first rollers is moved by the first roller 106 to the interconnecting tubing 130 under pressure and transmitted to the second stage 200 that is illustrated in FIG. 5B.

As the first rollers and second rollers move between the positions depicted in FIGS. 4A, 4B, 5A, and 5B, respectively, a "handoff" may occur between the first rollers and the second rollers such that a portion of the fluid trapped between a first roller located in the region between locations 305 and 308 and a second roller located in the region between locations 315 and 318 is subdivided as another second roller fully compresses the tubing in which the trapped fluid is located. The portion of fluid that is trapped between the two second rollers is thus "handed off" from the first stage to the second stage, and the second stage rollers move this handed-off portion of the fluid to the outlet under constant pressure. The other portion of the fluid that is trapped between the first roller and the (recently compressing) second roller is also moved at constant pressure towards the outlet. However, when that first roller stops fully compressing the tubing, e.g., such as at location 308, the portion of the fluid that was trapped between that first roller and a second roller will experience a pressure decrease as it equalizes with the lower-pressure fluid that was previously trapped between the two first rollers (which may be at or slightly above the intake pressure, depending on how much the pressure increases while such fluid is moved while trapped between the first rollers). The differential tangential speeds of the first roller and the second roller(s) as the first roller travels along the periphery of the first disk having the larger radii then raises the pressure of the fluid trapped between the first roller and the second roller up to the desired outlet pressure.

FIG. 5B illustrates the second stage 200 of the peristaltic pump with second rollers 206, 208 in a third position. Second roller 208 has moved from position 312 to position 314, and fully compressed tubing 204 at some location after position 312 and before reaching position 314. Second roller 206 has moved from position 316, where there is full compression, to position 318, where there is no compression of tubing 204. In this manner, second roller 208 has taken on the task of moving the fluid in tubing 204, while second roller 206 has moved to a position (e.g., position 318) where there is no compression, so that the fluid being moved by second roller 208 can pass through to the output tubing 230. As such, the second stage 200 simply moves the fluid by alternately using second rollers 206, 208 to advance the fluid in tubing 204. In some embodiments, the second disk 202 is configured such that full compression of tubing 204 is caused by a second roller moving between positions 312 and 314 before another second roller simultaneously moving between positions 316 and 318 is not fully compressing tubing 204.

As mentioned above, the peristaltic pump disclosed herein increases the pressure of a portion of fluid in the tubing between a first roller and a second roller by causing that first roller to move at a faster tangential speed around the first disk than that second roller. Again, this pressure increase is caused by the first roller pushing fluid against the second roller, thereby decreasing the length of tubing to contain the same volume of fluid, which causes the tubing to expand in order to accommodate the fluid, and thus increases the pressure of the fluid. The movement of the rollers and configuration of the disks to cause this pressure increase will now be discussed in further detail.

FIGS. 11A and 11B depict the peristaltic pump of FIGS. 3A and 3B, respectively, and as can be seen, most of the labels have been removed from FIGS. 3A and 3B and three shaded sectors in each disk have been added. As discussed above, the first rollers 106, 108 orbit around the periphery of the first disk at a constant angular speed and these first rollers 106, 108 are constantly pressed into contact to with the periphery of the first disk 102, the tubing 104, or the periphery of the first disk 102 and the tubing 104. In FIG. 11A, when first roller 106 orbits around disk 102 and reaches position 166 (which is between positions 303 and 304 on FIG. 3A, and which are not labeled in FIG. 11A), first roller 106 is fully compressing the tubing 104 and first roller 108 is no longer compressing tubing 104. At the same time, second roller 208 is at position 266 and is fully compressing tubing 204. Accordingly, a portion of fluid exists between first roller 106 and second roller 208 in tubing 104, 130, and 204; the bulk of the pressure increase in the fluid may occur in this trapped portion of the fluid.

First disk 102 in FIG. 11A includes a first angular sector 160 that spans between positions 166 and 168 (position 166 is between positions 303 and 304 and position 168 is between positions 304 and 305 of FIG. 3A), includes a first section of the periphery of the first disk 102 (not identified, but corresponding with the portion of the periphery between positions 166 and 168), and has a radius greater than the radius of the second disk 202 and greater than the radius in a second angular sector 162. As a first roller, such as first roller 106, moves along the first section of the periphery of first disk 102 between positions 166 and 168, that first roller is moving at a first tangential speed and is fully compressing the tubing. FIG. 11A also shows the second angular sector 162 that spans between positions 170 and 172 of the first disk (position 170 corresponds to position 305 and position 172 corresponds to position 306 in FIG. 3A), includes a second section of the periphery of the first disk 102 (not identified but corresponding with the portion of the periphery of the first disk between positions 170 and 172), and has a radius substantially equal to the radius of the second disk 202 and smaller than the radius of the first angular sector 160 (this radius corresponds to radius 125 in FIG. 3A). A first roller moving along the second section of the periphery of the first disk fully compresses the tubing 104 and moves at a second tangential speed that is less than the first tangential speed.

Referring to FIG. 11B, the second rollers 206, 208 orbit around the periphery of the second disk 202 at the same constant angular speed as the first rollers 106, 108. As noted above, the second rollers are constantly pressed into contact with the periphery of the second disk 202, the tubing 204, or the periphery of the second disk 202 and the tubing 204. Because the second disk has a substantially constant radius that also is substantially equal to the radius of the first disk in at least the second angular sector 162, the second rollers 206, 208 also move at substantially the second tangential speed. The second disk 202 also includes an angular sector 260 that includes a portion of the periphery of the second disk 202 as well as another angular sector 262 that includes another portion of the periphery of the second disk 202.

The first disk 102 of FIG. 11A and the second disk 202 of FIG. 11B and their respective rollers are aligned and configured as described herein in order to increase the pressure of the fluid trapped between a first roller and a second roller. For instance, when first roller 106 is at position 166 it is fully compressing the tubing 104, first roller 108 is between positions 172 and 174 such that it is not compressing the tubing 104, second roller 208 is at position 266 and fully compressing the tubing 204, and second roller 206 is partially compressing the tubing 204. As first roller 106 moves along the periphery of the first disk 102 within the first angular sector 160 at the first tangential speed, second roller 208 simultaneously moves along the angular sector 260 of the second disk at the second tangential speed. Because the first tangential speed is greater than the second tangential speed, first roller 106 pushes the fluid between the first roller 106 and the second roller 208 such that the pressure of this fluid is increased. The volume of the fluid remains the same but the length of tubing to contain the fluid is decreased, thus increasing the pressure in the tubing that expanded to accommodate the same fluid volume in the shorter length of tubing. In some embodiments, the pressure increase may cause the fluid to have a pressure increase of about 10 psi. This pressure increase occurs throughout the entire first angular sector 160.

In between the first angular sector 160 and the second angular section 162, there may be a transition sector, such as between positions 168 and 170, that that transitions from the radius of the first angular sector 160 and the radius of the second angular sector 162. This varying radius of the transition sector allows the radius of the first disk to reduce from the larger, first radius to the smaller, second radius. The pressure of the fluid may also be caused to increase as a first roller transits through the transition sector, although the rate at which the pressure increases increase will decrease as the first roller transits through the transition sector.

When the first roller 106 moves along the second angular sector 162, it moves at substantially the second tangential speed while the second roller 208 is simultaneously moving along the periphery of the second disk 202 through the another angular section 262 at substantially the second tangential speed. Because the tangential speeds of the first roller 106 and the second roller 208 substantially match at this period, the pressure of the fluid is not increased, but rather is maintained at a substantially constant pressure. The term "substantially" is used, in this instance, because there may be slight variations in speed or pressure in this section due to manufacturing tolerances or other negligible contributing factors. This movement by roller 106 from position 166 to 170 not only increases the pressure of the fluid, but also moves the fluid towards the outflow tubing 230; the movement from position 170 to position 172 also moves the fluid towards the outflow tubing 230 but does not increase the pressure of the fluid.

Accordingly, first disk 102 functions to increase the pressure of the fluid that is being drawn from the intake tubing 101 by causing the first rollers 106, 108 to move faster than the second rollers on longer-radius portions of the first disk 102 during certain portions of the cycle. As such, the two stage peristaltic pump is capable of pumping fluids with minimal pressure variation at the outlet, which results in little or no pulsing of the fluid at the output tubing 230. Additionally, referring back to FIG. 3A, when second roller 206 moves from position 316, where there is full compression, to position 318, where there is no compression, a volume is created in the tubing. Second roller 208 moves from position 312, where there is partial compression, to position 314, where there is full compression. As such, second roller 208 compresses the tubing, which displaces the same volume as the volume that is created when second roller 206 moves from position 316 to position 318. In this manner, a constant pressure is maintained.

As noted above, in some embodiments, the first disk 102 may have a first nominal radius throughout at least part of the first angular sector 160 and a second a second nominal radius throughout the second angular sector 162, the second disk 202 may have the second nominal radius, and the first nominal radius may be larger than the second nominal radius.

Referring back to FIG. 11A, after the first roller 106 has moved along the periphery of the first disk 102 of the second angular sector 162, the first roller 106 may be caused to move along a third angular sector 164 of the first disk 102 that is adjacent to the second angular sector 162 and spans between points 172 and 174. This third angular sector 164 may be configured to cause the first rollers to move along a third section of the periphery of the first disk at the second tangential speed (because the third angular sector 164 has substantially the same radius as the second angular sector 162 and the second disk 202). This third angular sector 164 may also be configured to cause the first roller to fully compress the tubing 104 at at least the beginning of the third angular sector 164 and to cause the one first roller 106 to not compress the tubing 104 at at least the end of the third angular section 164. For instance, as seen in FIG. 11A, the first roller 108 and 106 are fully compressing the tubing from positions 166 to at least 172. As stated above, as a first roller moves through the third angular sector, that first roller transitions from fully compressing the tubing 104 to not compressing the tubing 104.

Correspondingly, as a first roller is moving through the third angular sector 164, the second roller is moving through a different angular sector 264 at the second tangential speed. This different angular sector 264 spans between positions 272 and 274 which correspond to positions 316 and 318, respectively. As such, when a second roller traverses this angular section 264, it is fully compressing the tubing 204 at position 272 and not compressing the tubing 204 at position 274.

Additionally, as a first roller moves along the third angular sector 164, the first disk 102 may be configured to cause another first roller to fully compress tubing 104 before the first roller in the third angular sector stops fully compressing the tubing in the third angular sector, such as fully compressing the tubing 104 at position 303 of FIG. 3A, as described above. During this time, the second disk 202 may also be configured to cause another second roller to fully compress the tubing 204 against the second disk 202 before causing the one first roller to not fully compress the tubing 104 in the third angular sector 164. For example, as first roller 108 moves along the third angular sector 164, second roller 208 may fully compress tubing 204 at about position 266 on the second disk 202 before first roller 108 is not fully compressing tubing 104.

Similarly, the second disk 202 may also be configured to cause a second roller, such as second roller 206, to fully compress the tubing 204 when one first roller, such as first roller 108, is at least at the beginning of the third section of the periphery of the first disk 102 (i.e., the beginning of the fourth angular sector 164) and not to compress the tubing 204 when first roller 108 is at the end of the third section of the periphery of the first disk 102. For instance, when first roller 108 is at position 172 it is fully compressing tubing 104 and roller 206 is simultaneously at position 272 and fully compressing tubing 204; when first roller 108 is at position 174 and not compressing tubing 104, second roller 206 is simultaneously at position 274 and is not compressing tubing 204. As mentioned above, the second disk may be configured such that the other second roller is fully compressing tubing between positions 312 and 314 (as labeled in FIG. 3A) before the second roller is not compressing tubing 204 in third angular sector 264.

Figure 6:
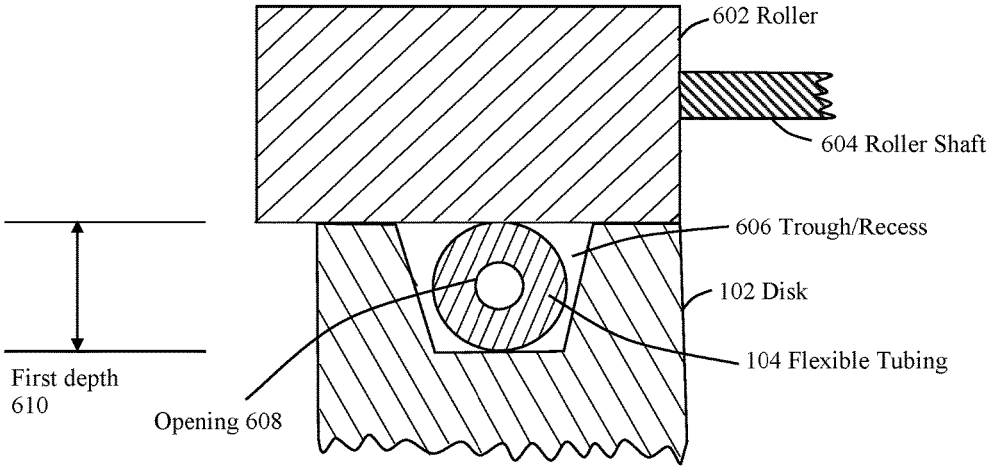
FIG. 6 is a schematic cross-sectional view of a roller and a disk with the opening in a flexible tubing being fully open.

FIG. 6 is a cross-sectional view of disk 102 and a first roller 602. Although FIGS. 6 through 9 are shown with the first disk 102, such embodiments may be equally applicable to the second disk. As shown on FIG. 6, the outer periphery of the first disk 102 has a trough 606 (i.e., recess). Where the trough 606 has a first depth 610, as shown in FIG. 6, the flexible tubing 104 is not compressed, since the first roller 602 rides along the outer, or peripheral portions of the first disk 102 and does not compress the flexible tubing 104. The flexible tubing has an opening 608 in this state that is not compressed and is fully open, so that fluid can easily flow through the flexible tubing 104 as a result of the first depth 610 of the trough 606 at this location on the periphery of the first disk 102. The tubing 104 has a nominal outer diameter in an undeformed state and trough 606 is configured such that the first depth 610 substantially matches this nominal outer diameter so that the first roller 602 does not compress the tubing 104. The first roller 602 rolls along the outer peripheral surface of the first disk 102 at the edges of the trough 606 and rotates on the roller shaft 604.

Figure 7:
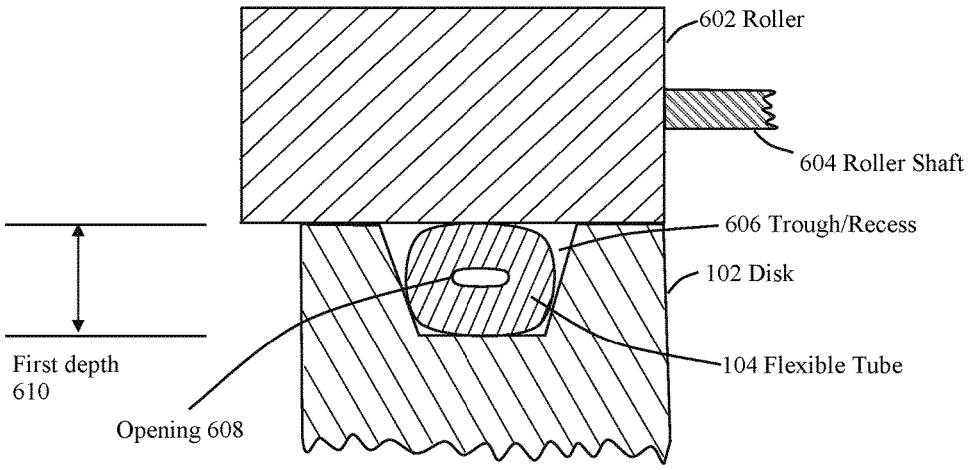
FIG. 7 is a schematic illustration of a roller and a disk illustrating the flexible tubing having an opening that is only partially open.

FIG. 7 is a cross-sectional view of the first disk 102, first roller 602, and flexible tubing 104 at a different location along the periphery of the first disk 102. As illustrated in FIG. 7, the trough 606 is not as deep as the trough 606 in FIG. 6, i.e., the first depth 610 in FIG. 7 is less than the first depth 610 depicted in FIG. 6. As such, the surface of the first roller 602 contacts the flexible tubing 104 and causes the flexible tubing 104 to be partially compressed in the trough 606. Again, the first roller 602 is rolling along the outer peripheral surface of the first disk 102 and rotating about roller shaft 604, as illustrated in FIG. 7. Since the flexible tubing 104 is compressed, the opening 608 is also partially compressed so that not as much fluid can flow through the opening 608 in the flexible tubing 104.

Figure 8:
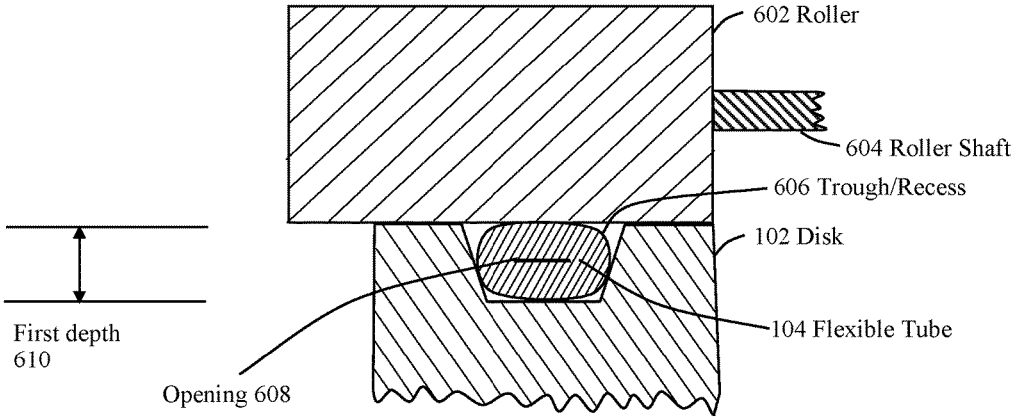
FIG. 8 is a schematic illustration of a roller and a disk with the flexible tubing having an opening that is fully closed.

FIG. 8 is a cross-sectional view of the first disk 102, first roller 602, and the flexible tubing 104 at another location along the periphery of the first disk 102. As illustrated in FIG. 8, the trough 606 is not as deep as the trough 606 in FIG. 7. In other words, the trough, or first recess, 606 has a first depth 610 that is less than the nominal outer diameter of the tubing, thereby causing the tubing 104 to extend past the periphery of the first disk 102 such that the first roller 602 fully compresses the tubing 104 in the trough 606 when the surface of the first roller 602 contacts the flexible tubing 104. Generally speaking, the first depth 610 would be less than or equal to twice the wall thickness of the tubing in order to cause such full compression. Tubing that is "fully compressed," as the term is used herein, is tubing that has been squashed or compressed to the point where no fluid is able to pass the point of compression within the tubing at the operating pressures utilized. Opening 608 is fully closed. Again, the first roller 602 is rolling along the outer peripheral surface of the first disk 102 around roller shaft 604, as illustrated in FIG. 8. Since the flexible tubing is fully compressed, the opening 608 is completely closed off so that no fluid can flow through the opening 608 in the flexible tubing 104.

Figure 9:
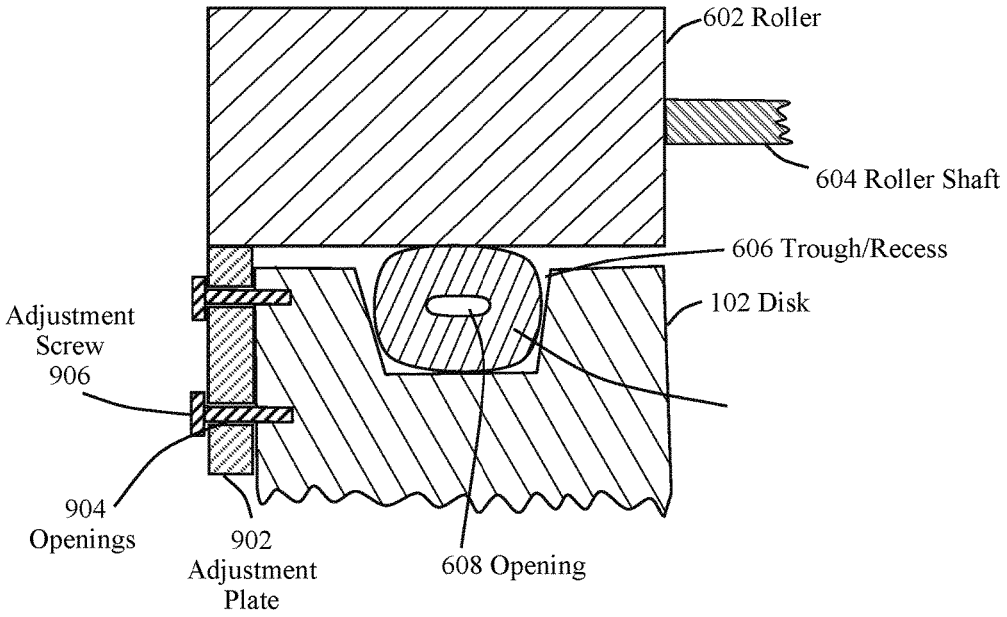
FIG. 9 is a schematic cross-sectional view of a roller and a disk and an adjustment plate to adjust the spacing between the roller and the disk.

FIG. 9 illustrates another embodiment of the manner in which the first roller 602 can be used to compress the flexible tubing 104 using an adjustment plate 902. As illustrated in FIG. 9, adjustment plate 902 is anchored to disk 102 by adjustment screws 906; the adjustment plate may be considered to be part of the first disk 102. The adjustment screws 906 extend through the openings 904 in the adjustment plate 902 and are screwed into the first disk 102. Other types of connectors could also be used that are well known in the art. The first roller 602, which rotates on roller shaft 604, rests on the outer surface of the adjustment plate 902. In this manner, if the trough 606 is not the desired depth, the adjustment plate 902 can be used to provide adjustment as to the location and amount which the first roller 602 compresses the flexible tubing 604. For instance, the adjustment plate may extend past a portion of the periphery of the first disk 102, thereby effectively extending the periphery of the first disk 102, and thereby cause the first roller 602 to be in contact with the first adjustment plate 902 and offset from the periphery of the first disk 102 such that the first roller 602 partially compresses the tubing 104. In some embodiments, this adjustment plate may form part of the trough 606, i.e., recess. Also, for example, at the location illustrated in FIG. 9, the opening 608 is partially open. Without the adjustment plate 902, the opening 608 would be fully closed if the first roller 602 was sitting on the peripheral edge of the first disk 102. In this manner, the pressure of the fluid can be adjusted, as well as the location where fluid can flow along the disk. By adjusting the radial location of the adjustment plate, the location where the roller fully compresses the flexible tubing can be adjusted, which allows both the pressure generated in the compression phase and the alignment of roller 206 and 208's transition to be adjusted.

Figure 10:
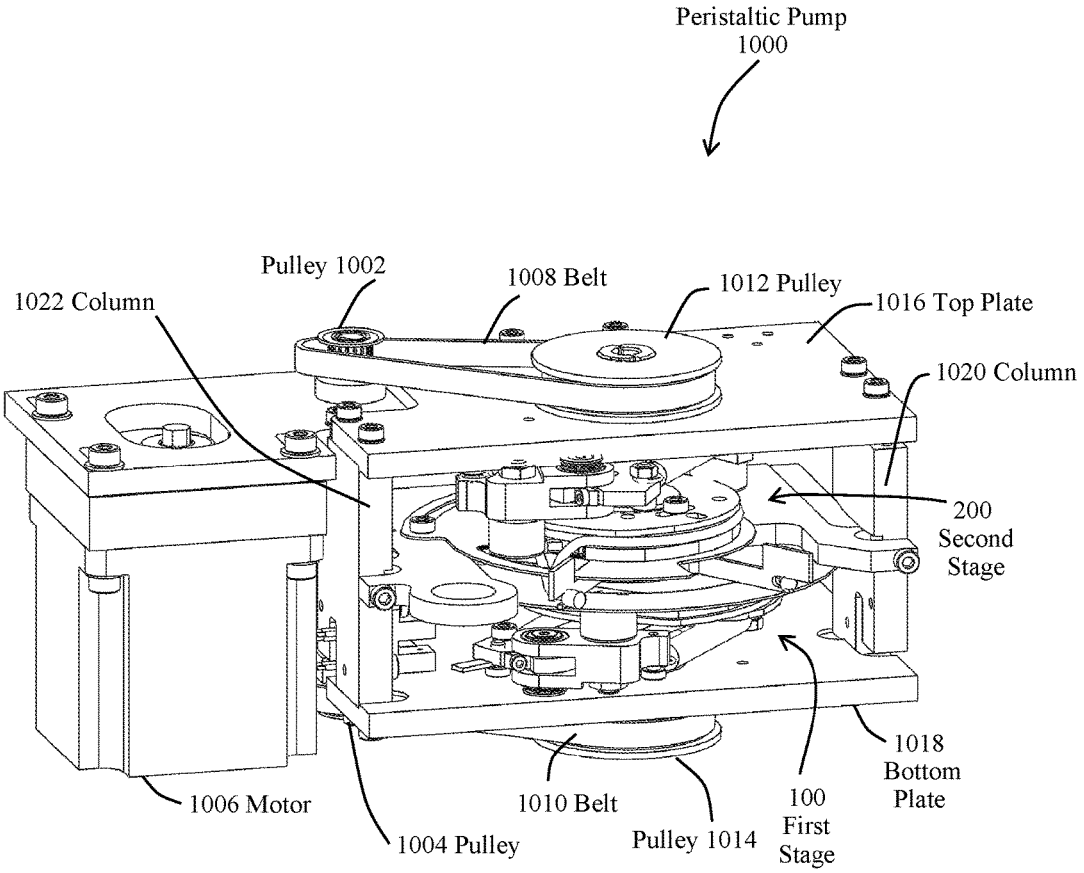
FIG. 10 is a schematic perspective view of an embodiment of a peristaltic pump.

FIG. 10 is a schematic perspective view of the peristaltic pump 1000. As illustrated in FIG. 10, second stage 200 is mounted directly over and aligned with the first stage 100. Pulley 1002 drives pulley 1012, with belt 1008. Pulley 1012 is mounted in top plate 1016 and drives the rotation of the first stage 100. Similarly, pulley 1004 drives belt 1010, which, in turn, drives pulley 1014; pulley 1014 drives the rotation of the second stage 200. Pulley 1002 and 1004 are connected to each other through a common shaft that proceeds through the center of both pulley 1002 and 1004 thus keeping the rotation of pulleys 1002 and 1004, and therefore stages 100 and 200 synchronized. The common shaft between pulleys 1002 and 1004 is driven by motor 1006 and a motor pulley, belt, and shaft pulley (not shown). In this manner, the rotation of the support arms of stage one and stage two is synchronized. Bottom plate 1018 provides the structural support for pulley 1014. Columns 1020, 1022 provide structural support for various portions of the peristaltic pump 1000. Motor 1006 drives the shaft that connects the pulleys 1002, 1004, which provides the rotational force to drive the peristaltic pump 1000. Accordingly, the shafts connecting pulleys 1002, 1004 and 1012, 1014 provide synchronization between the first stage 100 and the second stage 200 of the peristaltic pump. Further, since the two stages are aligned and connected in the manner shown, a compact design is provided for the peristaltic pump 1000.

The embodiments disclosed therefore provide a peristaltic pump 1000 with little or no pulsing of the output fluid at the desired output pressure. Disks are used that have varying radii that allow the fluid to be pre-pressurized in the first stage and subsequently pumped to an output by the second stage, resulting in little or no variations in output pressure of the output fluid. The fluid that is pumped by the peristaltic pump 1000 can be either a liquid or gas, or a mixture of liquid and gas. Although two rollers are illustrated in the various embodiments, three or more rollers can be used in either stage one and/or stage two.

It is to be understood that use of the term "substantially" in this application and the claims, unless otherwise indicated, refers to relationship that is within ±5% of the value specified. For example, "substantially the same tangential speed" would be within ±5% of the specified tangential speed. In a further example, a pressure that substantially matches another pressure would be within ±5% of that other pressure. A substantially circular shape would be a shape that has a boundary falling that falls within an annulus with an inner and outer diameter within ±5% of the diameter of a particular true circle.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of pumping a fluid through a tubing that is positioned partially around a periphery of a first disk of a peristaltic pump and partially around a periphery of a second disk of the peristaltic pump, the method comprising:

orbiting a plurality of first rollers at a constant angular speed around the periphery of the first disk such that the first rollers are constantly pressed into contact with the periphery of the first disk, the tubing, or the periphery of the first disk and the tubing, wherein the first disk includes a first angular sector that is configured to cause the first rollers to move along a first section of the periphery of the first disk at a first tangential speed and a second angular sector that is configured to cause the first rollers to move along a second section of the periphery of the first disk at a second tangential speed less than the first tangential speed;

orbiting a plurality of second rollers at the constant angular speed around the periphery of the second disk such that the second rollers are constantly pressed into contact with the periphery of the second disk, the tubing, or the periphery of the second disk and the tubing, wherein the second disk is configured to cause each second roller to move at substantially the second tangential speed;

increasing a pressure of a portion of the fluid in the tubing between one first roller and one second roller by causing the one first roller to fully compress the tubing in the first angular sector and simultaneously causing the one second roller to fully compress the tubing in a first section of the periphery of the second disk; and moving, after increasing the pressure of the portion of the fluid, the portion of the fluid through the tubing at a constant pressure towards an output of the tubing by causing the one first roller to fully compress the tubing in the second angular sector and simultaneously causing the one second roller to fully compress the tubing.

2. The method of claim 1, wherein:

the first disk has a first nominal radius throughout at least part of the first angular sector and a second nominal radius throughout the second angular sector, the second disk has the second nominal radius, and the first nominal radius is larger than the second nominal radius.

3. The method of claim 2, wherein the first disk gradually transitions in radius from the first radius to the second radius in between the first angular sector and the second angular sector.

4. The method of claim 1, wherein moving the portion of the fluid through the tubing at the constant pressure towards the output of the tubing further comprises:

causing, after the one first roller has moved along the second section of the periphery of the first disk:

the one first roller to move along a third angular sector of the first disk that includes a third section of the periphery of the first disk, wherein the first disk is configured to cause the one first roller to move along the third section at the second tangential speed, the one first roller to fully compress the tubing at at least a beginning of the third section in a direction of rotation of the first roller with respect to the first disk, and the one first roller to not fully compress the tubing at at least an end of the third section of the periphery of the first disk in the direction of rotation of the first roller with respect to the first disk; and causing another second roller to fully compress the tubing against the second disk before causing the one first roller to not fully compress the tubing at at least the end of the third section of the periphery of the first disk.

5. The method of claim 4, further comprising causing another first roller to fully compress the tubing before causing the one first roller to not fully compress the tubing at at least the end of the third section of the periphery of the first disk.

6. The method of claim 4, further comprising causing the one second roller to fully compress the tubing when the one first roller is at least at the beginning of the third section of the periphery of the first disk and not to compress the tubing when the one first roller is at least at the end of the third section of the periphery of the first disk.

7. The method of claim 1, wherein there are only two first rollers and only two second rollers.

8. The method of claim 1, further comprising drawing fluid into the tubing through an inlet by sequentially causing each first roller to fully compress the tubing and orbit around at least part of the periphery of the first disk.

9. The method of claim 1, wherein orbiting the plurality of first rollers at the constant angular speed around the periphery of the first disk and orbiting the plurality of second rollers at the constant angular speed around the periphery of the second disk includes fixing the first disk and the second disk in stationary positions and causing the plurality of first rollers to orbit around the first disk and causing the plurality of second rollers to orbit around the second disk.

10. The method of claim 1, wherein the output is configured to supply the fluid to one of a flow cell or a cuvette.

11. The method of claim 1, wherein the output of the tubing has a pressure that substantially matches the constant pressure of the portion of the fluid.

12. The method of claim 1, wherein the output is configured to supply the fluid to a nozzle of a flow cytometer.

13. An apparatus, comprising:

a first disk, including:

a first recess in the periphery of the first disk, the first recess configured to receive a first portion of tubing for conveying fluid, a first angular sector that has a nominal first radius and includes a first section of a periphery of the first disk, and a second angular sector that has a nominal second radius and includes a second section of the periphery of the first disk, wherein the second radius is smaller than the first radius, and wherein the first section of the periphery of the first disk is longer than the second section of the periphery of the first disk;

a second disk that is substantially circular, has the nominal first radius, and includes a second recess in a periphery of the second disk, the second recess configured to receive a second portion of the tubing;

a plurality of first rollers that are configured to orbit around the periphery of the first disk at a constant angular speed and configured to, when the first portion of the tubing is in the first recess, constantly press into contact with the periphery of the first disk, the tubing, or the periphery of the first disk and the tubing; and a plurality of second rollers that are configured to orbit around the periphery of the second disk at the constant angular speed and configured to, when the second portion of the tubing is in the second recess, constantly press into contact with the periphery of the second disk, the tubing, or the periphery of the second disk and the tubing, wherein:

the first disk is configured such that each first roller moves in the first angular sector at a first tangential speed while fully compressing the tubing and such that each first roller moves in the second angular sector at a second tangential speed while fully compressing the tubing, the second disk is configured such that each second roller moves around the periphery of the second disk at the second tangential speed, the first disk, second disk, first rollers, and second rollers are configured to cause one first roller to fully compress the tubing while moving in the first angular sector and to simultaneously cause one second roller to fully compress the tubing while moving in a first section of the periphery of the second disk, and the first disk, second disk, first rollers, and second rollers are further configured to cause, after the one first roller has moved past the first angular sector, the one first roller to fully compress the tubing in the second angular sector and to simultaneously cause the one second roller to fully compress the tubing.

14. The apparatus of claim 13, wherein the first disk gradually transitions in radius from the first radius to the second radius in between the first angular sector and the second angular sector.

15. The apparatus of claim 13, wherein:

the first disk is further configured to cause, after the one first roller has moved along the second section of the periphery of the first disk:

the one first roller to move along a third angular sector of the first disk that includes a third section of the periphery of the first disk, wherein the first disk is configured to cause the one first roller to move along the third section at the second tangential speed, the one first roller to fully compress the tubing at at least a beginning of the third section in a direction of rotation of the first roller with respect to the first disk, the one first roller to not fully compress the tubing at at least an end of the third section in the direction of rotation of the first roller with respect to the first disk; and the second disk is further configured to cause another second roller to fully compress the tubing against the second disk before the one first roller is caused to not fully compress the tubing at at least the end of the third section of the periphery of the first disk.

16. The apparatus of claim 13, further comprising:

a first roller support on which the first rollers are mounted; and a second roller support on which the second rollers are mounted, wherein the first roller support and the second roller support are configured to rotate about a common center axis at the constant angular speed.

17. The apparatus of claim 13, further comprising the tubing that is positioned partially around the periphery of the first disk in the first recess and positioned partially around the periphery of the second disk in the second recess.

18. The apparatus of claim 13, wherein:

in the sections of the periphery of the first disk where the first rollers fully compress the tubing, the first recess has a first depth that is less than a nominal outer diameter of the tubing, causing the tubing to extend past the periphery of the first disk such that the first rollers fully compress the tubing, and in the sections of the periphery of the second disk where the second rollers fully compress the tubing, the second recess has a second depth that is less than the nominal outer diameter of the tubing and that causes the tubing to extend past the periphery of the second disk such that the second rollers fully compress the tubing.

19. The apparatus of claim 13, wherein the first disk includes a first adjustment plate, wherein the first adjustment plate is movable with respect to the remainder of the first disk such that locations along the periphery of the first disk where full compression of the tubing occurs between the first disk and a first roller are tunable.

20. The apparatus of claim 13, wherein the second disk includes a second adjustment plate, wherein the second adjustment plate is movable with respect to the remainder of the second disk such that locations along the periphery of the second disk where full compression of the tubing occurs between the second disk and a second roller are tunable.

* * * * *